US007172534B1

(12) United States Patent
Joy et al.

(10) Patent No.: US 7,172,534 B1
(45) Date of Patent: Feb. 6, 2007

(54) JUMP ROPE SIMULATOR

(76) Inventors: Cynthia L. Joy, 985 Old Orchard Rd., Campbell, CA (US) 95008; Kenneth R. Johnson, 985 Old Orchard Rd., Campbell, CA (US) 95008; F. Michael Sophir, 1405 S. Cherry St., Denver, CO (US) 80222

( * ) Notice: Subject to any disclaimer, the term of this patent is extended or adjusted under 35 U.S.C. 154(b) by 689 days.

(21) Appl. No.: 10/639,962

(22) Filed: Aug. 12, 2003

Related U.S. Application Data

(60) Provisional application No. 60/403,749, filed on Aug. 13, 2002.

(51) Int. Cl.
*A63B 5/20* (2006.01)

(52) U.S. Cl. ..... 482/82; 482/44; 482/81; 482/110; 482/148

(58) Field of Classification Search ..... 482/44, 482/79, 81, 82, 109, 110, 140, 148, 907, 908; D21/672; 446/219, 242, 307, 266, 247; 463/47.5; 473/429, 430; 273/330, 129 K
See application file for complete search history.

(56) References Cited

U.S. PATENT DOCUMENTS 2,723,121 A * 11/1955 Cartwright et al. ..... 482/82
3,082,571 A * 3/1963 Lewis ..... 446/247
3,475,023 A * 10/1969 Fauvelle ..... 482/82
4,682,774 A * 7/1987 Holy ..... 463/47.5
5,004,228 A * 4/1991 Powers ..... 482/91
5,984,845 A * 11/1999 Powers ..... 482/148
6,193,637 B1 * 2/2001 Corbin ..... 482/121
6,196,921 B1 * 3/2001 Larson ..... 463/47.2
6,524,226 B2 * 2/2003 Kushner ..... 482/126
6,540,649 B1 * 4/2003 Niedrich ..... 482/82
6,736,763 B1 * 5/2004 Hsu ..... 482/82
6,752,746 B1 * 6/2004 Winkler et al. ..... 482/82
6,887,188 B1 * 5/2005 Davies ..... 482/82

FOREIGN PATENT DOCUMENTS

CA 1164490 A * 3/1984

* cited by examiner

*Primary Examiner*—Jerome Donnelly
*Assistant Examiner*—Victor K. Hwang
(74) *Attorney, Agent, or Firm*—Haverstock & Owens LLP

(57) ABSTRACT

A jump rope simulator for aerobic and anaerobic exercise having a hand-held unit comprising a handle, a base length connected to the handle, and one or more concatenated extension lengths attached to the base length. To exercise, the user grasps one or two units, imitates the motions of swinging a conventional jump rope, and jumps up and down, but there is no risk to the user of tripping over a rope as with a conventional jump rope. If the user desires, two units may also be linked together with an easily attachable connector to form a device similar to a conventional jump rope. A user can quickly convert between the two configurations of the jump rope simulator.

42 Claims, 5 Drawing Sheets

JUMP ROPE SIMULATOR

RELATED APPLICATIONS

This Patent Application claims priority under 35 U.S.C. 119 (e) of the co-pending U.S. Provisional Patent Application Ser. No. 60/403,749, filed Aug. 13, 2002, and entitled, "JUMP ROPE SIMULATOR AND METHOD OF EXERCISE." The Provisional Patent Application Ser. No. 60/403,749, filed Aug. 13, 2002, and entitled, "JUMP ROPE SIMULATOR AND METHOD OF EXERCISE" is also hereby incorporated by reference.

FIELD OF THE INVENTION

The present invention relates generally to aerobic and anaerobic exercise devices, and more specifically to a new jump rope simulator for providing aerobic and anaerobic exercise.

BACKGROUND OF THE INVENTION

Traditional jump ropes are usually made from a single length of rope with handles at both ends for the user to grip. The user holds the rope by the handles, swings the rope over his head and then under his feet in a continuous motion, and jumps over the rope every time it passes under his feet. If the user should misjudge when the rope is under his feet, he will trip over the rope and lose the rhythm and timing of the exercise workout. One way to obtain the beneficial aerobic workout associated with a traditional jump rope and yet avoid tripping over a rope is to use a jump rope simulator which does not actually pass a rope under the user's feet. One hand-held unit or two unconnected hand-held units are grasped in the user's hands and rotated while the user skips periodically and rhythmically, without having to actually jump over a physical rope, thus simulating a traditional jump rope exercise.

The use of jump rope simulators for aerobic exercise is known in the prior art. U.S. Pat. No. 5,895,341 to Jones entitled, "Jump Rope Simulator," discloses a pair of hand-held units each having a handle and a flexible cord with a weight distribution biased toward the free end of the cord and intended to be rotated about an axis extending from the handle in a manner similar to the motions employed when using a standard jump rope. Optional embodiments include handles that contain a battery-powered jump counting device with display and a battery-powered calorie counting device with display.

U.S. Pat. No. 6,524,226 to Kushner entitled, "Exercise Device," discloses a pair of elastic bands each having a longitudinal handle and a lateral handle. The elastic bands can be joined together with a fastener and used as a single resistive force device for isometric exercises, or the two elastic band units can be held individually, one in each hand of the user, for use as a jump rope simulator. The lengths of the elastic bands may be adjusted through the use of pins that are removably positioned in apertures located in the handle and band.

While these patents disclose an exercise device wherein a user can simulate the motions associated with using a traditional style jump rope, neither of the disclosed constructions allow the user the option of using the jump rope simulator as an individual unit or as a linked device formed by connecting two individual units which results in a device similar in form and function to a conventional jump rope.

SUMMARY OF THE INVENTION

The present invention is a device and method to be used for aerobic and anaerobic exercise. A jump rope simulator of the present invention has a hand-held unit comprising a handle, a fixed length tube with one end permanently attached to the handle, a series of concatenated tubular beads removably connected to the second end of the tube, and a ball-shaped safety nodule attached to the bead farthest removed from the tube. A simple mechanism is used for connecting the beads together so that a user may quickly adjust the length of the unit. The length of the unit can be repeatedly adjusted by adding or removing beads from the unit. Preferably the length of the unit is adjusted such that the safety nodule just touches the floor when the handle of the unit is held in a relaxed position by the user's side. A sound mechanism is preferably included in the handle so that as the fixed length tube rotates around the hand-held unit, a sound is made on each rotation. A connector is used to link together two units of the jump rope simulator by removing the safety nodules and linking the beads farthest removed from the handles of the two units. A simple mechanism is also used to link the connector to the last bead of the two units so that a user is able to quickly convert between the two configurations of the jump rope simulator.

An alternative embodiment includes a flexible cord which runs down the center of the tube and beads and is attached to the handle on one end and the safety nodule or the last bead farthest removed from the handle on the other end. The presence of the cord in the unit ensures that the beads and the safety nodule are secured to the handle. Even if one of the connections were to inadvertently release during an exercise workout, none of the pieces would fly off, and the jump rope simulator would still function. Having this safety feature would be especially important in a group exercise environment such as a fitness club or an aerobic and/or anaerobic workout class.

According to an embodiment of the present invention, the beads are attached to each other through the use of a simple, low-cost interlocking snap-fit mechanism on the beads. One end of each bead has a spherical protrusion and the other end of each bead has a socket that accepts the spherical protrusion. The first end of one bead plugs into the second end of another bead, and the beads can be easily added or removed by a user without the use of any tools. In this way, a user can adjust the number of beads on the unit and thus adjust the length of the unit to accommodate the user's height. Preferably the bodies of the tubular beads have accordion-like pleated folds to provide for flexibility in the unit so that the unit moves freely and mimics the feel of a rope during use and is also easy to store and transport between uses.

According to another embodiment of the present invention, the beads are attached to each other with the use of threaded screw-type male and female ends on the beads. One end of each bead is a threaded male end and the other end of each bead is a threaded female socket. The first end of one bead screws into the second end of another bead, and the beads can be easily added or removed by a user without the use of any tools. In this way, a user can adjust the number of beads on the unit and thus adjust the length of the unit to accommodate the user's height. Preferably the bodies of the tubular beads have accordion-like pleated folds to provide for flexibility in the unit so that the unit moves freely and mimics the feel of a rope during use and is also easy to store and transport between uses.

According to yet another embodiment of the present invention, the beads are attached to each other through the use of a screw-type coupler between the beads. Both ends of each bead are threaded female sockets. A tubular coupling screw having two threaded male ends is used to easily link together two beads. Alternatively, both ends of each bead are threaded male ends, and a tubular coupling screw having two threaded female ends is used to easily link together two beads. This simple low-cost connecting mechanism between the beads allows the user to adjust the number of beads on the unit and thus to adjust the length of the unit to accommodate the user's height without using any tools. Preferably the body of the tubular coupling screw has accordion-like pleated folds to provide for flexibility in the unit so that the unit moves freely and mimics the feel of a rope during use and is easy to store and transport between uses.

Incorporating elements containing accordion-like pleated folds into the units of the jump rope simulator not only allows units to bend but also to stretch. Units having this versatility are used effectively, either as individual units or as linked units, for a variety of stretching or Pilates-type movements for body conditioning or physical therapy programs.

Optional features of the present invention include different safety nodules having various weights which serve to increase the resistance felt by the user as the unit is being rotated or swung in the user's hand, a light emitting device such that the safety nodule at the end of the unit emits light as the user is exercising and alerts other people in the neighboring vicinity that the unit is in motion, a two-piece rotatable ergonomic handle with a right-angle bend that helps to guide the safety nodule end of the unit away from the user's legs when the unit is being rotated, and a variable weight handle capable of holding weights to increase the resistance felt by the user as the unit is being rotated or swung in the user's hand. Preferably the variable weight handle is a hollow handle in which different valued weights may be loaded. Another alternative to varying the weight of the handle is to screw weights onto the free end of the handle. In such a configuration, the end-cap of the handle is removed, exposing a threaded female socket for accepting a screw-on weight. The screw-on weight is a disk that has the same diameter as the handle with a threaded male end on one side of the disk for screwing into the free end of the handle. The other side of the disk has a threaded female socket for accepting an additional screw-on weight or the handle's end-cap.

DETAILED DESCRIPTION OF THE INVENTION

Figure 1:
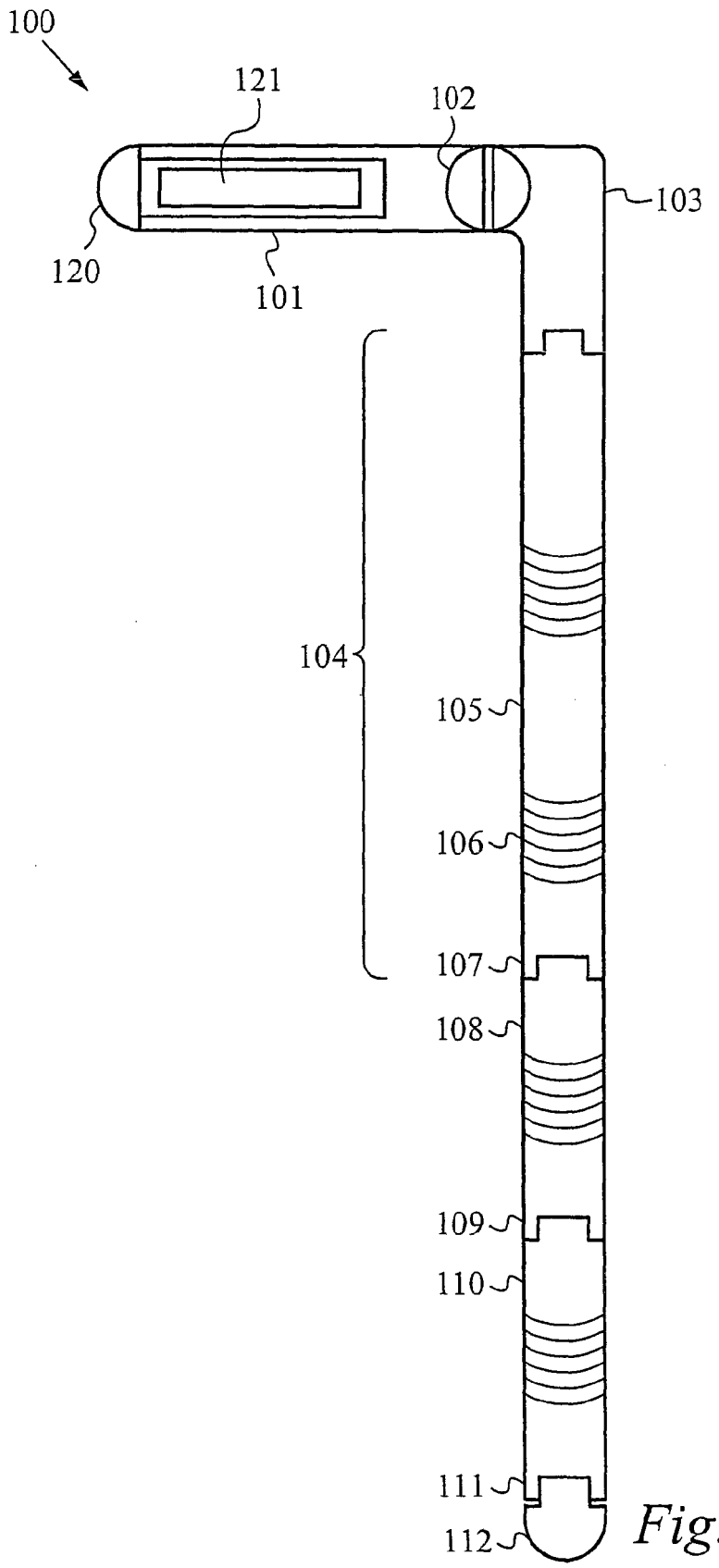
FIG. 1 shows the preferred embodiment of the jump rope simulator in accordance with the present invention.

FIG. 1 illustrates a jump rope simulator 100 in accordance with the preferred embodiment of the present invention. The jump rope simulator unit 100 has a handle that is L-shaped and padded on the long side 101 with a resilient material in an ergonomic shape that fits comfortably in a user's hand during exercise workouts. The handle has a short side 103 that is attached to the long side of the handle 101 by a ball-bearing joint 102 which allows the short side of the handle 103 to rotate 360 degrees around the longitudinal axis of the long side of the handle. A sound mechanism is preferably built into the ball-bearing joint 102 such that for each rotation of the handle 103 around the long side of the handle, an audible sound is output. The rotatable handle is designed so that when the user rotates the individual unit, the far end of the unit is prevented from impacting the user's legs. The long side of the handle 101 is preferably hollow and has a removable end-cap 120. A weight 121, available in various values, can be inserted inside the hollow handle. The weight adds extra resistance when the user is rotating the jump rope simulator in an aerobic and anaerobic workout.

Also shown in FIG. 1 is a fixed length tube 104 permanently attached to the end of the short side of the handle 103. The tube provides stability to the unit as it is being rotated by the user and also contributes to guiding the ends of the unit away from the user's legs in conjunction with the L-shaped handle. Along the body of the tube 104, there are alternating sections that are smooth 105 and accordion-like with pleated folds 106. The pleated folds provide the tube with some flexibility in bending when a user is rotating the jump rope simulator and also allow bending of the units so that the unit can be stored in a compact manner. Attached to the bottom of the tube 104 is a sequence of several beads that are each preferably shorter in length than the tube 104. Only two beads are shown in FIG. 1, although any appropriate number of beads may be connected by the user to adjust the overall length of the unit to reach the floor and accommodate the user's height. The bead 108 is connected to the tube 104 at the connector 107, while the bead 110 is connected to the bead 108 at the connector 109. Each of the beads 108 and 110 also have accordion-like pleated folds in the body to provide for flexibility in the bead. At the bottom of the last bead on the unit is a ball-shaped safety nodule 112 which is attached to the last bead 110 by the connector 111. The round safety nodule 112 is preferably made out of a soft material so that if the user inadvertently hits himself or another person while using the jump rope simulator, the safety nodule will cushion the impact. The safety nodule 112 is available in several different weights that provide variable resistance to the user during his aerobic and anaerobic workout with the jump rope simulator.

As used herein, the term beads refers to any non-locking or interlocking segments, sections, tubular elements, collars or cylinders which can be used to extend the length of the jump rope simulator of the present invention.

The length of the unit can be repeatedly adjusted by adding or removing beads from the unit. This allows the same unit to be repeatedly adjusted for use by users of different heights. Conventional jump ropes typically only allow for a single length adjustment by cutting the rope.

Figure 2:
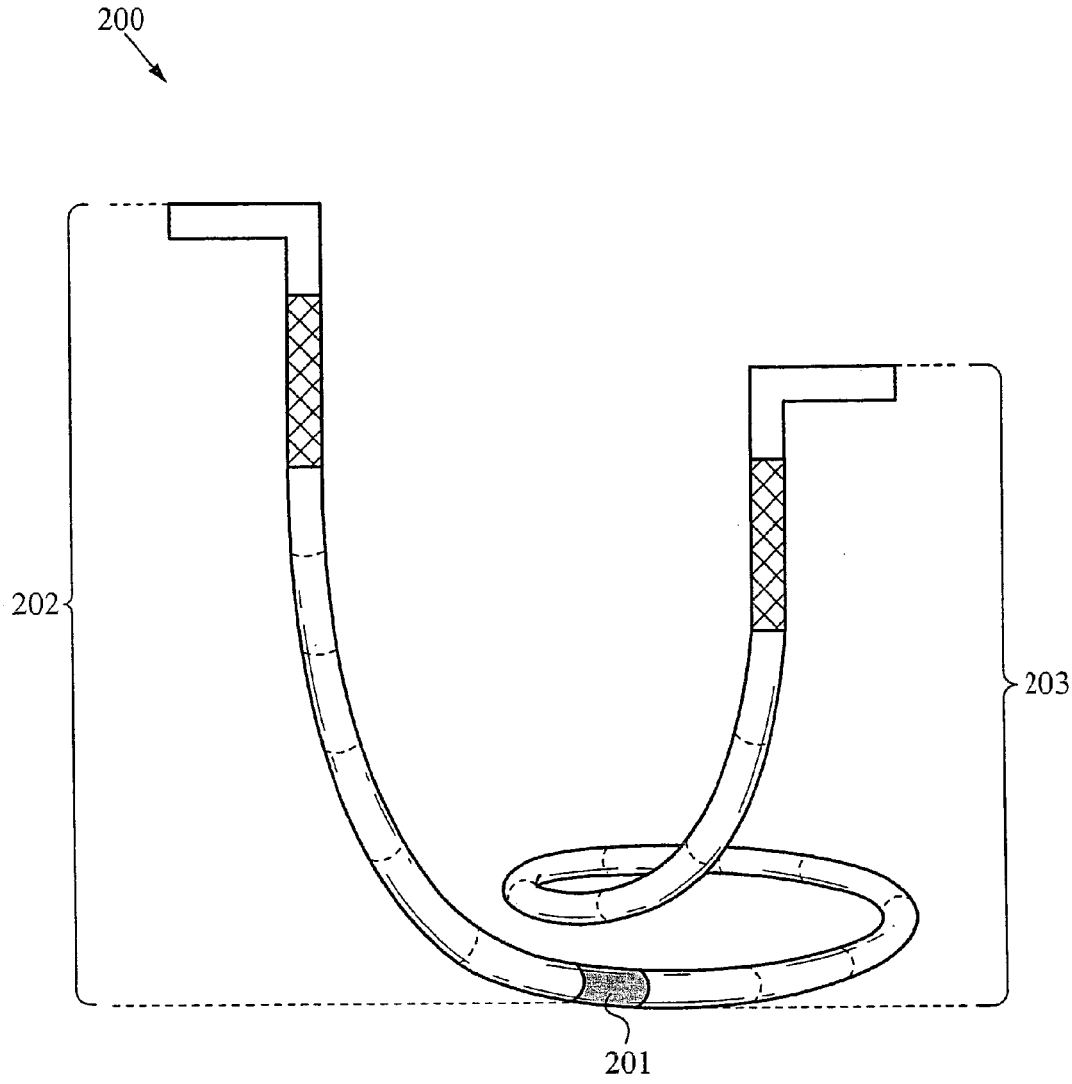
FIG. 2 shows two units of the jump rope simulator linked together with a removable connector.

FIG. 2 illustrates two units 202 and 203 of the jump rope simulator linked to each other with a removable connector 201. In this configuration, the safety nodule 112 at the end of the unit shown in FIG. 1 is removed from both of the units 202 and 203, and the connector 201 is directly connected to the bead farthest away from the handle of each unit. The linking of the two units results in a device 200 that can be used in a similar manner as a conventional jump rope. The connector 201 is available in several different lengths to allow the user to modify the total length of the linked jump rope simulator to fit a particular user's height. The connector 201 can be positioned anywhere between the two handles of each unit.

Figure 3:
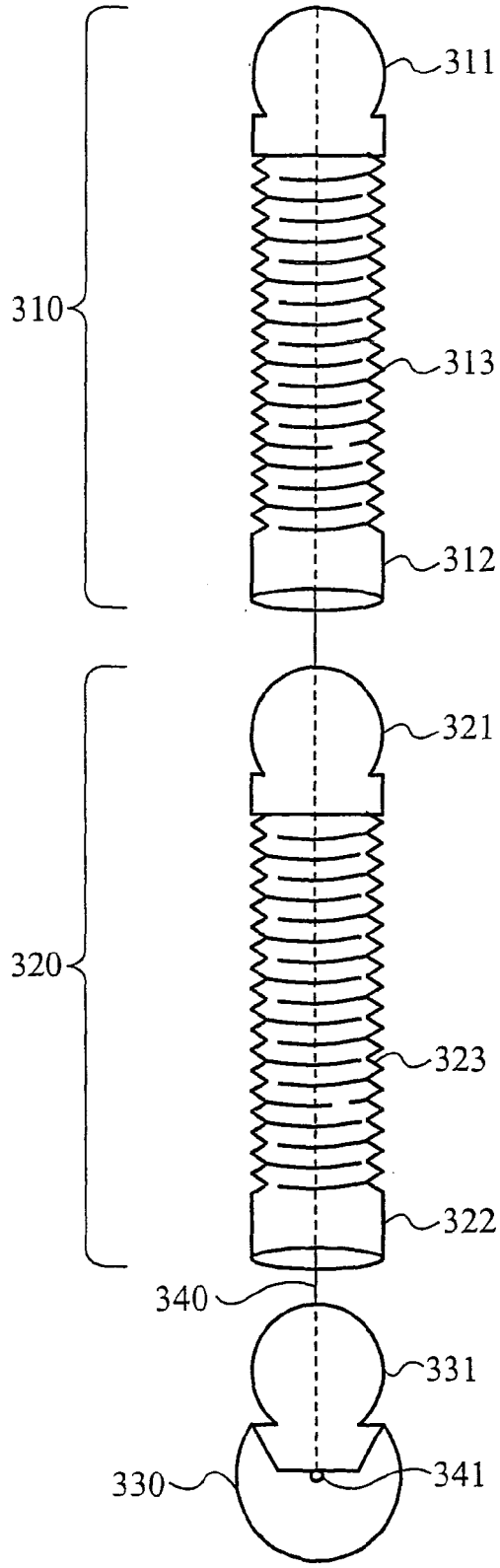
FIG. 3 shows an exploded view of two beads and a safety nodule having a snap-fit type of connection according to an alternate embodiment of the present invention.

FIG. 3 is an exploded view of two beads 310 and 320 and a safety nodule 330 attachable to each other with a snap-fit type of connection. The two beads 310 and 320 each have a spherically-shaped protrusion 311 and 321 on one end and a socket 312 and 322 for accepting a spherically-shaped protrusion on the other end. The tubular body of each bead 313 and 323 has accordion-like pleated folds which allow for flexibility in bending the bead. As shown in FIG. 3, the spherically-shaped protrusion 321 on the top end of the bottom bead 320 plugs into the socket 312 in the bottom end of the top bead 310 in a snap-fit manner. This simple mechanism allows users to easily add or remove beads to adjust the length of the unit to accommodate the user's height. Plugged into the socket 322 located at the bottom end of the bottom bead 320 is a ball-shaped safety nodule 330 which is made out of a soft material. The safety nodule 330 also has a spherically-shaped protrusion 331 for plugging into the socket 322. In addition the exploded view in FIG. 3 shows a flexible cord 340 on which the beads are strung; in ordinary use, after assembly the cord would be hidden from view. The flexible cord 340 ends in a knot 341 which securely fastens the safety nodule 330 to the unit.

Figure 4:
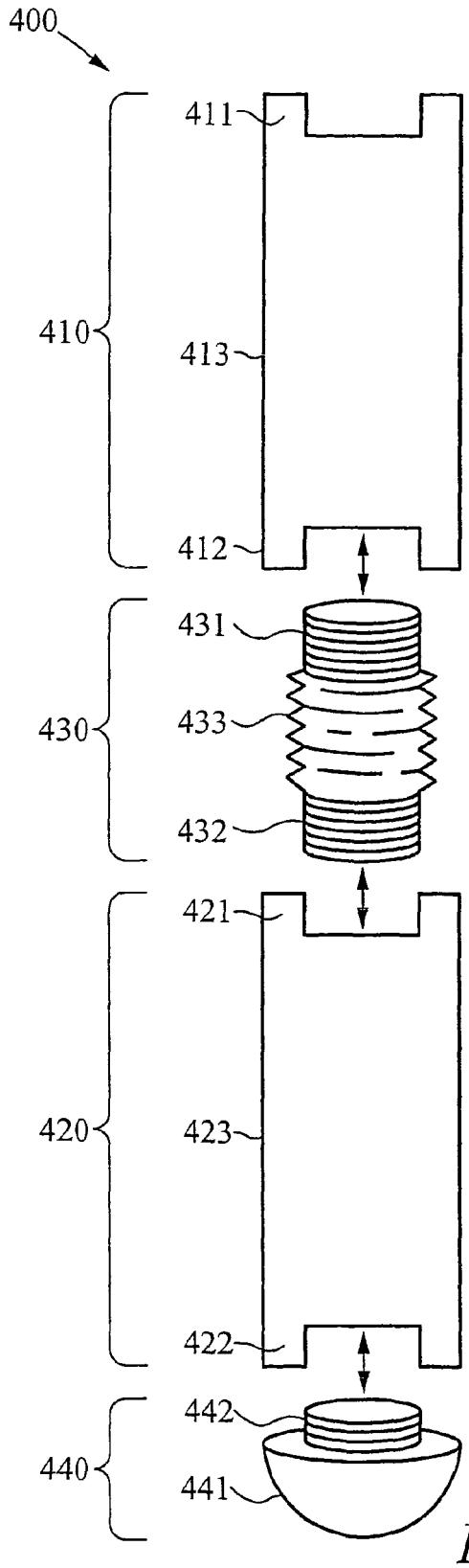
FIG. 4 shows an exploded view of two beads and a safety nodule with a screw-coupler type of connector according to an alternate embodiment of the present invention.

FIG. 4 is an exploded view 400 of two beads 410 and 420 and a safety nodule 440 attachable to each other with a screw-coupler type of connector. Both ends of each of the beads 411, 412, 421, and 422 is a threaded female socket. A coupler screw 430 having two threaded male ends 431 and 432 is used to connect the two beads 410 and 420. The tubular body 433 of the coupler screw 430 has accordion-like pleated folds to allow the connected beads to have flexibility in bending. This simple screw-type mechanism allows users to easily add or remove beads 413 and 423 to adjust the length of the unit to accommodate the user's height. As shown in FIG. 4, the safety nodule 440 has a ball shape 441 and a threaded male end 442. The threaded male end 442 of the safety nodule screws into the bottom 422 of the last bead in the series.

Figure 5:
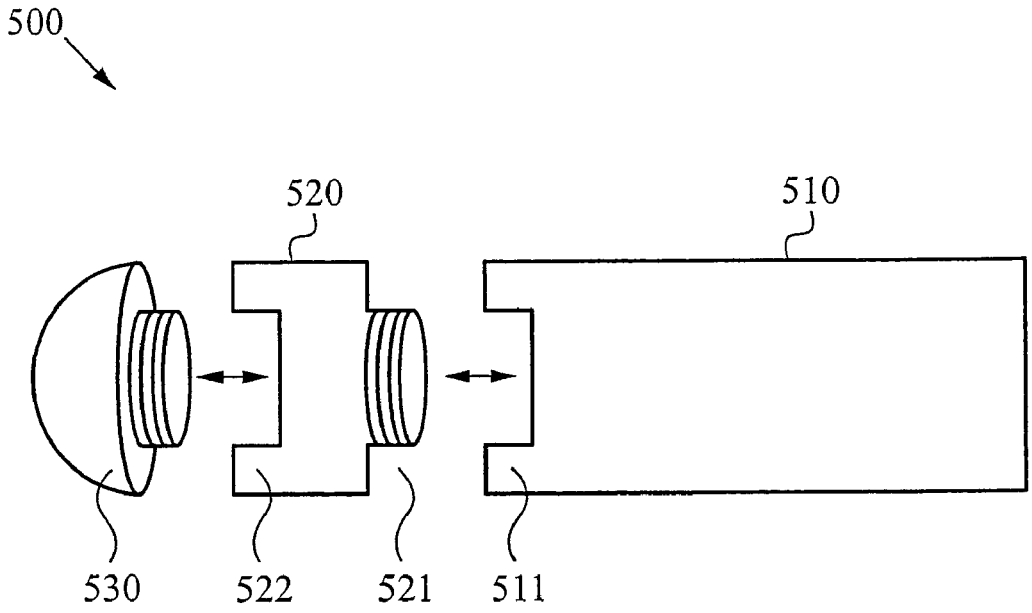
FIG. 5 shows an exploded view of the end of the handle and a screw-on weight according to an alternate embodiment of the present invention.

FIG. 5 is an exploded view 500 of the free end of the handle 510 and a screw-on weight 520. The free end of the handle 510 has a threaded female socket 511 to accept the screw-on weight 520. The screw-on weight 520 is disk-shaped and has a threaded male end 521 on one side which screws to the free end of the handle 510. The other side of the screw-on disk-shaped weight has a threaded female socket 522. This socket can accept another screw-on weight to increase the total weight of the handle or the handle end-cap 530 which also has a threaded male end.

To assemble a jump rope simulator, a user takes the handle with attached tube and attaches a bead to the free end of the tube. The user continues attaching additional beads to increase the total length of the unit until a length appropriate for the user is reached. The ideal length allows the safety nodule to just touch the floor when the handle of the unit is held in a relaxed position by the user's side. Finally, at the end of the concatenation of beads the user attaches a safety nodule.

Use of the jump rope simulator as an exercise device is straightforward. For the configuration where the device is used as an individual unit or a pair of units, as shown in FIG. 1, the user simply grasps the handle in his hand and rotates the unit(s), simulating the feeling and rhythm of rotating a conventional jump rope. Because of the sound mechanism within the ball-bearing joint 102, the user also receives a simulated audible feedback as if a jump rope were hitting the floor on each rotation. The user can also jump or skip on each rotation of the rotating handle and exercise continuously without worrying about tripping over an actual rope and losing his balance, rhythm, and timing as would typically occur when a user trips over a conventional jump rope. However, should the user desire to exercise with a traditional style jump rope, two units of the simulator are easily connected together as shown in FIG. 2. The connection and detachment of the two units is very simple, thus allowing the user to choose which exercise device configuration meets his needs and to quickly switch between the two configurations as desired.

Multiple users have the ability to each utilize a pair of jump rope simulators in a group or class type environment in order to participate in a group workout. This allows the group of users to perform a series of exercises using the jump rope simulators of the present invention for aerobic and anaerobic exercise. This series of exercises can be performed to music to provide a rhythm and pace for the exercise.

Further, the level of exertion of the user's exercise program can be changed by increasing or decreasing the amount of weight loaded in the handle or attached to the end of the handle. Alternatively, the safety nodule at the end of the unit may be exchanged for another safety nodule having a different weight. The weight of the unit can also be increased or decreased by any other appropriate manner, including adding weight to the handle or to the end of the beads or safety nodule.

The present invention discloses an exercise device wherein a user can simulate the motions and aerobic and anaerobic exercise benefits associated with using a traditional style jump rope without the risk of tripping over a physical rope. The jump rope simulator of the present invention has several advantages over the prior art. A user is able to easily and repeatedly modify the length of the jump rope simulator by adding or removing beads. A user is also able to easily and repeatedly modify the weight of the jump rope simulator either at the handle or at the safety nodule in order to increase or decrease the resistance of the unit as it is being rotated in the user's hand. Also, if the user desires, two of the jump rope simulator units are easily linked together with a simple connector to form a device similar to a conventional jump rope in form and function. The teachings of the present invention allow a user to quickly convert between the two configurations of the jump simulator.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and have several different appearances.

What is claimed is:

1. A jump rope simulator comprising:

a. a handle;

b. a base length including a base coupler, the base length coupled to the handle, wherein the base coupler is positioned on an end of the base length away from the handle; and c. one or more extension lengths each including a first extension coupler on a first end and a second extension coupler on a second end and a tubular body having accordion-like pleated folds to allow for flexibility in bending the extension length, wherein the first extension coupler of a first extension length is coupled to the base coupler and any additional extension lengths are coupled to each other.

2. The jump rope simulator as claimed in claim 1, wherein a last extension length is coupled to a connector to couple two jump rope simulators together to form a continuous jump rope device.

3. The jump rope simulator as claimed in claim 1, further comprising a flexible cord having a first end and a second end wherein the cord threads through the base length and the extension lengths and the first end of the cord is attached to the handle and the second end of the cord is attached to the extension length farthest away from the handle.

4. The jump rope simulator as claimed in claim 1, wherein the handle has a removable end-cap, and the handle is hollow to accommodate replaceable handle weights.

5. The jump rope simulator as claimed in claim 1, wherein the handle has a removable end-cap, and additional weights are attachable between the handle and the end-cap.

6. The jump rope simulator as claimed in claim 1, wherein the handle is an L-shaped handle having a long section and a short section; the long section of the handle is padded with a resilient material ergonomically shaped to fit in a user's hand and has a longitudinal axis; the short section of the handle is attached to the long section of the handle by a ball-bearing joint that allows 360 degree rotation of the short section of the handle around the longitudinal axis of the long section of the handle.

7. The jump rope simulator as claimed in claim 1, wherein the first extension coupler of each extension length is a spherically-shaped protrusion, and the second extension coupler of each extension length is a socket for accepting a spherically-shaped protrusion such that the extension lengths can be snap-fit together, and further wherein the base coupler is a socket for accepting a spherically-shaped protrusion.

8. The jump rope simulator as claimed in claim 1, wherein the first extension coupler and the second extension coupler of each extension length is a threaded female socket for engaging with a coupling screw having two threaded male ends, and further wherein the base coupler is a threaded male end.

9. The jump rope simulator as claimed in claim 1, wherein the first extension coupler and the second extension coupler of each extension length is a threaded male end for engaging with a coupling screw having two threaded female sockets, and further wherein the base coupler is a threaded female socket.

10. The jump rope simulator as claimed in claim 1, wherein the first extension coupler of each extension length is a threaded female socket and the second extension coupler of each extension length is a threaded male end such that the extension lengths can be coupled together, and further wherein the base coupler is a threaded male end.

11. A jump rope simulator comprising:

a. a handle;

b. a flexible base length including a base coupler, the base length coupled to the handle, wherein the base coupler is positioned on an end of the base length away from the handle;

c. one or more flexible extension lengths each including a first extension coupler on a first end and a second extension coupler on a second end and a tubular body having accordion-like pleated folds to allow for flexibility in bending the extension length, wherein the first extension coupler of a first extension length is coupled to the base coupler and extension lengths are coupled to each other; and d. a ball-shaped end piece including an end piece coupler, wherein the end piece coupler is coupled to the second extension coupler of the extension length farthest away from the handle.

12. The jump rope simulator as claimed in claim 11, wherein a last extension length is coupled to a connector to couple two jump rope simulators together to form a continuous jump rope device.

13. The jump rope simulator as claimed in claim 11, further comprising a flexible cord having a first end and a second end wherein the cord threads through the base length and the extension lengths and the first end of the cord is attached to the handle and the second end of the cord is attached to the end piece.

14. The jump rope simulator as claimed in claim 11, further comprising a flexible cord having a first end and a second end wherein the cord threads through the base length and the extension lengths and the first end of the cord is attached to the handle and the second end of the cord is attached to the extension length farthest away from the handle.

15. The jump rope simulator as claimed in claim 11, wherein the handle has a removable end-cap, and the handle is hollow to accommodate replaceable handle weights.

16. The jump rope simulator as claimed in claim 11, wherein the handle has a removable end-cap, and additional weights are attachable between the handle and the end-cap.

17. The jump rope simulator as claimed in claim 11, wherein the handle is an L-shaped handle having a long section and a short section; the long section of the handle is padded with a resilient material ergonomically shaped to fit in a user's hand and has a longitudinal axis; the short section of the handle is attached to the long section of the handle by a ball-bearing joint that allows 360 degree rotation of the short section of the handle around the longitudinal axis of the long section of the handle.

18. The jump rope simulator as claimed in claim 11, wherein the first extension coupler of each extension length is a spherically-shaped protrusion, and the second extension coupler of each extension length is a socket for accepting a spherically-shaped protrusion such that the extension lengths can be snap-fit together, and further wherein the base coupler is a socket for accepting a spherically-shaped protrusion, and the end piece coupler has a spherically-shaped protrusion to snap-fit into the second extension coupler of an extension length.

19. The jump rope simulator as claimed in claim 11, wherein the first extension coupler and the second extension coupler of each extension length is a threaded female socket for engaging with a coupling screw having two threaded male ends, and further wherein the base coupler is a threaded male end, and the end piece coupler is a threaded male end.

20. The jump rope simulator as claimed in claim 11, wherein the first extension coupler and the second extension coupler of each extension length is a threaded male end for engaging with a coupling screw having two threaded female sockets, and further wherein the base coupler is a threaded female socket, and the end piece coupler is a threaded female socket.

21. The jump rope simulator as claimed in claim 11, wherein the first extension coupler of each extension length is a threaded female socket and the second extension coupler of each extension length is a threaded male end, and further wherein the base coupler is a threaded male end, and the end piece coupler is a threaded female socket.

22. The jump rope simulator as claimed in claim 11, wherein the end piece is interchangeable with another end piece having a different weight.

23. A jump rope simulator comprising:

a. a handle having a near end and a distal end;

b. a tube having a top end, a bottom end, and a flexible body, wherein the top end is permanently coupled to the distal end of the handle, and the body has smooth tubular sections alternating with accordion-like tubular sections with pleated folds to allow for flexibility in bending the tube;

c. one or more cylindrical beads strung end-to-end from the bottom end of the tube, each bead comprising a first end and a second end and a tubular body wherein the first end of each bead is attachable to the second end of another bead and further wherein the first end of the bead closest to the tube is attached to the bottom end of the tube, and the beads are concatenated together and individually removable by a user for adjusting a length of the jump rope simulator; and d. a ball-shaped safety nodule attached to the bead farthest removed from the handle, wherein the safety nodule has means for attaching to the second end of the bead farthest away from the handle, and the safety nodule is made out of a soft material.

24. The jump rope simulator as claimed in claim 23, wherein a last bead is coupled to a connector to couple two jump rope simulators together to form a continuous jump rope device.

25. The jump rope simulator as claimed in claim 23, further comprising a flexible cord having a first end and a second end wherein the cord threads through the tube and the beads and the first end of the cord is attached to the handle and the second end of the cord is attached to the safety nodule.

26. The jump rope simulator as claimed in claim 23, further comprising a flexible cord having a first end and a second end wherein the cord threads through the tube and the beads and the first end of the cord is attached to the handle and the second end of the cord is attached to the bead farthest away from the handle.

27. The jump rope simulator as claimed in claim 23, wherein the handle has a removable end-cap, and the handle is hollow to accommodate replaceable handle weights.

28. The jump rope simulator as claimed in claim 23, wherein the handle has a removable end-cap, and additional weights are attachable between the handle and the end-cap.

29. The jump rope simulator as claimed in claim 23, wherein the handle is an L-shaped handle having a long section and a short section; the long section of the handle is padded with a resilient material ergonomically shaped to fit in a user's hand, has a longitudinal axis and a removable end-cap at the near end; the short section of the handle is attached to the long section of the handle by a ball-bearing joint that allows 360 degree rotation of the short section of the handle around the longitudinal axis of the long section of the handle.

30. The jump rope simulator as claimed in claim 23, wherein the first end of each bead has a spherically-shaped protrusion, and the second end of each bead has a socket for accepting a spherically-shaped protrusion such that the beads can be snap-fit together, and the tubular body of each bead has accordion-like pleated folds to allow for flexibility in bending the bead, and further wherein the bottom end of the tube is a socket to accept the first end of a bead, and the safety nodule has a spherically-shaped protrusion to snap-fit into the second end of a bead.

31. The jump rope simulator as claimed in claim 23, wherein the first end and the second end of each bead is a threaded female socket for engaging with a coupling screw having two threaded male ends, and further wherein the bottom end of the tube is a threaded male end to engage with the first end of a bead, and the safety nodule has a threaded male end to engage with the second end of a bead.

32. The jump rope simulator as claimed in claim 23, wherein the first end and the second end of each bead is a threaded male end for engaging with a coupling screw having two threaded female sockets, and further wherein the bottom end of the tube is a threaded female socket to engage with the first end of a bead, and the safety nodule has a threaded female socket to engage with the second end of a bead.

33. The jump rope simulator as claimed in claim 23, wherein the first end of each bead is a threaded female socket and the second end of each bead is a threaded male end such that the beads can be coupled together, and further wherein the bottom end of the tube is a threaded male end to engage with the first end of a bead, and the safety nodule has a threaded female socket to engage with the second end of a bead.

34. The jump rope simulator as claimed in claim 23, wherein the safety nodule is interchangeable with another safety nodule having a different weight.

35. A jump rope simulator comprising:

a. an L-shaped handle having a near end, a distal end, a long section and a short section, wherein the long section of the handle is padded with a resilient material ergonomically shaped to fit in a user's hand, has a longitudinal axis and a removable end-cap at the near end, and is hollow to accommodate replaceable handle weights, and further wherein the short section of the handle is attached to the long section of the handle by a ball-bearing joint that allows 360 degree rotation of the short section of the handle around the longitudinal axis of the long section of the handle;

b. a tube having a top end, a bottom end, and a flexible body, wherein the top end is permanently coupled to the distal end of the handle, and the body has smooth tubular sections alternating with accordion-like tubular sections with pleated folds to allow for flexibility in bending the tube;

c. one or more cylindrical beads strung end-to-end from the bottom end of the tube, each bead comprising a first end and a second end and a tubular body wherein the first end of each bead is attachable to the second end of another bead and further wherein the first end of the bead closest to the tube is attached to the bottom end of the tube, and the beads are concatenated together and individually removable by a user for adjusting a length of the jump rope simulator; and d. a ball-shaped safety nodule attached to the bead farthest removed from the handle, wherein the safety nodule has means for attaching to the second end of the bead farthest away from the handle, and further wherein the safety nodule is interchangeable with another safety nodule having a different weight.

36. The jump rope simulator as claimed in claim 35, further comprising a flexible cord having a first end and a second end wherein the cord threads through the tube and the beads and the first end of the cord is attached to the handle and the second end of the cord is attached to the safety nodule.

37. The jump rope simulator as claimed in claim 35, further comprising a flexible cord having a first end and a second end wherein the cord threads through the tube and the beads and the first end of the cord is attached to the handle and the second end of the cord is attached to the bead farthest away from the handle.

38. The jump rope simulator as claimed in claim 35, wherein additional weights are attachable between the handle and the removable end-cap.

39. The jump rope simulator as claimed in claim 35, wherein the first end of each bead has a spherically-shaped protrusion, and the second end of each bead has a socket for accepting a spherically-shaped protrusion such that the beads can be snap-fit together, and the tubular body of each bead has accordion-like pleated folds to allow for flexibility in bending the bead, and further wherein the bottom end of the tube is a socket to accept the first end of a bead, and the safety nodule has a spherically-shaped protrusion to snap-fit into the second end of a bead.

40. The jump rope simulator as claimed in claim 35, wherein the first end and the second end of each bead is a threaded female socket for engaging with a coupling screw having two threaded male ends, and further wherein the bottom end of the tube is a threaded male end to engage with the first end of a bead, and the safety nodule has a threaded male end to engage with the second end of a bead.

41. The jump rope simulator as claimed in claim 35, wherein the first end and the second end of each bead is a threaded male end for engaging with a coupling screw having two threaded female sockets, and further wherein the bottom end of the tube is a threaded female socket to engage with the first end of a bead, and the safety nodule has a threaded female socket to engage with the second end of a bead.

42. The jump rope simulator as claimed in claim 35, wherein the first end of each bead is a threaded female socket and the second end of each bead is a threaded male end such that the beads can be coupled together, and further wherein the bottom end of the tube is a threaded male end to engage with the first end of a bead, and the safety nodule has a threaded female socket to engage with the second end of a bead.

* * * * *